US005085117A

United States Patent [19]

Morokuma et al.

[11] Patent Number: 5,085,117

[45] Date of Patent: Feb. 4, 1992

[54] ELECTRONIC MUSICAL INSTRUMENT WITH ANY KEY PLAY MODE

[75] Inventors: Hiroshi Morokuma; Shigeru Matsuyama; Takashi Akutsu, all of Tokyo, Japan

[73] Assignee: Casio Computer Co., Ltd., Tokyo, Japan

[21] Appl. No.: 592,556

[22] Filed: Oct. 4, 1990

[30] Foreign Application Priority Data

| | | | |
|---|---|---|---|
| Oct. 6, 1989 | [JP] | Japan | 1-117684[U] |
| Oct. 6, 1989 | [JP] | Japan | 1-117685[U] |
| Oct. 11, 1989 | [JP] | Japan | 1-118976 |
| Jul. 17, 1990 | [JP] | Japan | 2-75253 |

[51] Int. Cl.[5] ..... G10B 3/10; G10H 1/02

[52] U.S. Cl. ..... 84/615; 84/DIG. 2; 84/DIG. 7

[58] Field of Search ..... 84/DIG. 2, 618, 615, 84/626, 609, 649, 653, 656, 658, 678, 684, DIG. 7

[56] References Cited

U.S. PATENT DOCUMENTS

| | | |
|---|---|---|
| 4,022,097 | 5/1977 | Strangio . |
| 4 ,361,067 | 11/1982 | Ishii . |
| 4,448,104 | 5/1984 | Hoshii . |
| 4,476,766 | 10/1984 | Ishii . |
| 4,522,100 | 6/1985 | Ishii . |
| 4,594,931 | 6/1986 | Ishii . |

FOREIGN PATENT DOCUMENTS

| | | |
|---|---|---|
| 62-32791 | 7/1987 | Japan . |

*Primary Examiner*—William M. Shoop, Jr.
*Assistant Examiner*—Helen Kim
*Attorney, Agent, or Firm*—Frishauf, Holtz, Goodman & Woodward

[57] ABSTRACT

In an electronic musical instrument with an ANY KEY mode which regards keys as a single one-key, an ON event in a non-operation state is valid, and a one-key play operation is advanced by one tone.

9 Claims, 11 Drawing Sheets

FIG.10A MAXNOCODE

| MSB (7) | 6 | 5 | 4 | 3 | 2 | 1 | LSB (0) |
|---|---|---|---|---|---|---|---|
| | | | | | | | |

FIG.10B MINNOCODE

| MSB (7) | 6 | 5 | 4 | 3 | 2 | 1 | LSB (0) |
|---|---|---|---|---|---|---|---|
| | | | | | | | |

FIG.10C MAXNFCODE

| MSB (7) | 6 | 5 | 4 | 3 | 2 | 1 | LSB (0) |
|---|---|---|---|---|---|---|---|
| | | | | | | | |

FIG.10D MINNFCODE

| MSB (7) | 6 | 5 | 4 | 3 | 2 | 1 | LSB (0) |
|---|---|---|---|---|---|---|---|
| | | | | | | | |

FIG.10E MAXCODE

| MSB (7) | 6 | 5 | 4 | 3 | 2 | 1 | LSB (0) |
|---|---|---|---|---|---|---|---|
| | | | | | | | |

FIG.10F MINCODE

| MSB (7) | 6 | 5 | 4 | 3 | 2 | 1 | LSB (0) |
|---|---|---|---|---|---|---|---|
| | | | | | | | |

FIG.10G ON/OFF

| | | | | | | | LSB (0) |
|---|---|---|---|---|---|---|---|
| | | | | | | | |

FIG.10H D

| 7 (MSB) | 6 | 5 | 4 | 3 | 2 | 1 | LSB (0) |
|---|---|---|---|---|---|---|---|
| 0 | 0 | 0 | 0 | 0 | 1 | 0 | 1 |

ELECTRONIC MUSICAL INSTRUMENT WITH ANY KEY PLAY MODE

Background of the Invention

1. Field of the Invention

The present invention relates to an electronic musical instrument which plays a melody which is stored in advance in accordance with an operation of, e.g., a keyboard.

2. Description of the Related Art

A conventional electronic musical instrument normally has a so-called one-key play mode (e.g., U.S. Pat. Nos. 4,022,097 and 4,448,104, and Published Examined Japanese Patent Application No. 62-32791). In an electronic musical instrument of this type, a special key called a one-key is arranged at a position separated from a keyboard. When the one-key is depressed in correspondence with a rhythm, a predetermined melody stored in, e.g., a ROM pack automatically progresses. According to a musical instrument of this type, a beginner can easily play various melodies in correct rhythm.

In the one-key play mode, a user only depresses a key called the one-key in place of key depression operations on the keyboard. Therefore, the user cannot experience that he or she actually plays a keyboard, resulting in dissatisfaction.

For this reason, in some musical instruments, all the keys on the keyboard are regarded as the one-keys, and a melody progresses every time an arbitrary key on the keyboard is depressed (e.g., U.S. Pat. Nos. 4,476,766, 4,361,076, 4,594,931, and 4,522,100).

However, the keys on the keyboard are arranged adjacent to each other without gaps. For this reason, a beginner tends to erroneously depress a plurality of keys at the same time. In this case, melody tones progress by the number of depressed keys not to be synchronized with rhythm. Recently, electronic musical instruments tend to be utilized as early music education tools or toys for infants. However, it is difficult for infants to precisely depress keys one by one, and they tend to simultaneously tap a plurality of keys with their fists or palms. For this reason, in order to assist infants to learn a rhythmical sense of a melody, an auto play function which recognizes a simultaneous depression of a plurality of keys as an operation of one key, and plays a melody is preferable. In this case, it is also preferable for an electronic musical instrument that a performance using both hands can be performed like in acoustic keyboards such as a piano, an organ, a cembalo, and the like.

SUMMARY OF THE INVENTION

It is an object of the present invention to provide an electronic musical instrument with which an infant or a beginner can easily play various melodies with both hands.

In order to achieve the above object, the present invention can provide arrangements according to various aspects.

According to the first aspect of the present invention, there is provided an electronic musical instrument comprising a plurality of pitch designation means arranged to designate pitches, and divided into a plurality of groups, pitch data storage means for storing pitch data indicating pitches of melody tones constituting a melody, readout means for sequentially reading out the pitch data from said pitch data storage means, and tone generation processing means for executing tone generation processing on the basis of the pitch data read by said readout means every time the pitch designation means in an arbitrary one of said plurality of groups is depressed in a state wherein none of the pitch designation means are operated.

In the first aspect of the present invention, the pitch designation means comprises, e.g., a key, and designates an arbitrary pitch. According to the present invention, a plurality of pitch designation means are arranged to be able to designate pitches in units of, e.g., semitones. These pitch designation means are divided into a plurality of groups.

The pitch data storage means comprises a ROM pack, a ROM chip, or the like, which can be detachably mounted on an apparatus main body, and stores pitch data indicating a pitch of each melody tone constituting an arbitrary melody. The pitch data is binary or hexadecimal data in one-to-one correspondence with each pitch, and is stored along the progress of a melody.

The readout means comprises, e.g., a microprocessor, and reads out the pitch data from the pitch data storage means along the progress of a melody at predetermined timings.

The tone generation processing means executes tone generation processing on the basis of the readout pitch data every time the plurality of pitch designation means in an arbitrary group are operated in a state wherein none of them are operated.

The operations of the means according to the first aspect are as follows.

When at least one pitch designation means is operated in a state wherein none of the plurality of pitch designation means in an arbitrary group are operated (to be referred to as a one-key operation hereinafter for the sake of convenience), the tone generation processing means generates a note (or a tone) having a pitch indicated by pitch data read out by the readout means. The tone is generated such that the tone generation processing means controls an MIDI (Musical Instrument Digital Interface) sound source upon transmission of MIDI data based on MIDI standards or controls an internal or external digital or analog sound source.

When the one-key operation is performed in an arbitrary group, a melody tone based on pitch data read out from the pitch data storage means by the readout means is generated by the tone generation processing means.

In this manner, melody tones are read out and generated one by one along the progress of a melody every time a one-key operation is independently performed in units of groups.

The one-key operation is independently performed in units of groups. Therefore, when one-key operations of two different groups are respectively performed with both hands, a melody can also be played.

The one-key operation in an arbitrary group is enabled only when at least one pitch designation means is operated in a state wherein none of the pitch designation means are operated. Even when a plurality of pitch designation means are operated with a fist or palm, only one tone is generated. Therefore, an infant can play a melody while he or she simultaneously operates a plurality of pitch designation means with his or her fist or palm.

According to the second aspect of the present invention, there is provided an electronic musical instrument comprising a plurality of pitch designation means for designating pitches, pitch data storage means for storing pitch data indicating pitches of melody tones constituting a melody, readout means for sequentially reading out the pitch data from said pitch data storage means, and tone generation processing means for, when operation states of said plurality of pitch designation means are changed from a state wherein none of said plurality of pitch designation means are operated to a state wherein at least one pitch designation means is operated, or when the number of operated pitch designation means is changed from a first predetermined value to a second predetermined value, executing tone generation processing on the basis of the pitch data read by said readout means.

In the second aspect of the present invention, the pitch designation means, the pitch data storage means, and the readout means have the same arrangements as those in the first aspect described above.

When at least one pitch designation means is operated in a state wherein none of the plurality of pitch designation means are operated, or when the number of pitch designation means in operation is changed from a first predetermined value to a second predetermined value, the tone generation processing means executes tone generation processing on the basis of the pitch data read out by the readout means.

The operations of the means according to the second aspect are as follows.

When at least one pitch designation means is operated in a state wherein none of the plurality of pitch designation means are operated, the tone generation processing means generates a melody tone having a pitch designated by pitch data on the basis of the pitch data read out by the readout means. The melody tone is generated in the same manner as in the first aspect described above.

When one or a plurality of pitch designation means are operated in a state wherein an arbitrary number of pitch designation means have already been operated, and a total number of pitch designation means in operation is changed, the tone generation processing means generates a melody tone having a pitch indicated by new pitch data when it determines that the total number is changed from a first predetermined value to a second predetermined value.

In this manner, a melody tone is generated on the basis of pitch data read out from the pitch data storage means by the readout means in accordance with a change in number of pitch designation means in operation.

In this manner, when the number of pitch designation means in operation is changed from the first predetermined value to the second predetermined value, a melody progresses tone by tone. Thus, when the ranges of the first and second predetermined values are appropriately set, the next melody tone can be generated even when keys are depressed with one hand while another hand is depressing other keys. Even when the number of pitch designation means in operation is changed, no melody tone is generated if the total number of pitch designation means in operation does not reach the second predetermined value. Therefore, even when a plurality of pitch designation means are simultaneously operated with a fist or palm, only one new melody tone can be generated. Therefore, an infant can smoothly play a melody while he or she operates a plurality of pitch designation means with his or her fists or palms alternately.

According to the third aspect of the present invention, there is provided an electronic musical instrument comprising a plurality of pitch designation means for designating pitches, pitch data storage means for storing pitch data indicating pitches of melody tones constituting a melody, readout means for sequentially reading out the pitch data from said pitch data storage means, and tone generation processing means for, when operation states of said plurality of pitch designation means are changed from a state wherein none of said plurality of pitch designation means are operated to a state wherein at least one pitch designation means is operated, or when the pitch designation means separated from the already operated pitch designation means by a predetermined value or more is operated, executing tone generation processing on the basis of the pitch data read by said readout means.

According to the third aspect of the present invention, the pitch designation means, the pitch data storage means, and the readout means have the same arrangements as those in the first and second aspects described above.

When at least one pitch designation means is operated in a state wherein none of the plurality of pitch designation means are operated, or when the pitch designation means at a position separated by a predetermined number of pitch designation means or more from the pitch designation means which has been already operated is operated, the tone generation processing means executes tone generation processing on the basis of the pitch data read out by the readout means.

The operations of the means of the third aspect are as follows.

When a pitch designation operation of at least one pitch designation means is detected in a state wherein none of the plurality of pitch designation means are operated, the tone generation processing means generates a melody tone having a pitch designated by pitch data on the basis of the pitch data read out by the readout means. The melody tone is generated in the same manner as in the tone generation processing means of the first and second aspects.

When one or a plurality of new pitch designation means are operated in a state wherein an arbitrary pitch designation means has already been operated, if the newly operated pitch designation means are separated from a position (or a region) of the already operated pitch designation means by a predetermined distance (corresponding to the number of keys in a keyboard) or more, the tone generation processing means generates a melody tone having a pitch designated by pitch data on the basis of the pitch data read out by the readout means.

In this manner, a melody tone based on pitch data read out from the pitch data storage means by the readout means is generated by the tone generation processing means in accordance with a change in operation of the pitch designation means.

When a new pitch designation means is operated while at least one pitch designation means has already been operated, if the newly operated pitch designation means is separated from the already operated pitch designation means by a predetermined distance (corresponding to the predetermined number of keys in the case of a keyboard) or more, the next melody tone can be generated. Therefore, when the predetermined distance (the predetermined number of keys) is set to be an appropriate value, if, for example, an infant depresses a keyboard with his right and left fists or palms alternately, a melody tone can be generated according to a new key depression by his or her one hand even if the other hand still depresses other keys. In a similar case, however, when a key too close to the already depressed key is depressed, the key depression is ignored, and no melody tone is generated. Therefore, like in the first and second aspects, even when an infant simultaneously operates a plurality of pitch designation means with his or her fists or palms, only one melody tone can be generated. Therefore, an infant can smoothly play a melody while he or she operates a plurality of pitch designation means with his or her fists or palms alternately.

The effects of each of the above aspects can be summarized as follows.

According to the first aspect of the present invention, a pitch designation unit such as a keyboard consisting of a plurality of pitch designation means is divided into a plurality of groups; a timing at which at least one pitch designation means is operated in a state wherein none of the pitch designation means are operated is independently detected in units of groups; and a melody tone is generated and progresses one by one in synchronism with the detected timing. Therefore, a melody can be smoothly played with both hands.

According to the second aspect of the present invention, not only when a pitch designation operation is performed in a state wherein none of pitch designation means are operated, but also when a total number of operated pitch designation means is changed from a first predetermined value to a second predetermined value, only one melody tone is generated. Therefore, even when none of pitch designation means are operated, if a pitch designation operation satisfying the above-mentioned condition is performed, one melody tone progresses. Therefore, for example, when an infant performs pitch designation operations with his or her right and left hands using fists or palms, a melody can be smoothly and easily played with both the hands.

Furthermore, according to the third aspect of the present invention, not only when a pitch designation operation is performed in a state wherein none of pitch designation means are operated, but also when a pitch designation means at a position separated from the already operated pitch designation means by the predetermined number of pitch designation means or more is operated, the next melody tone is generated. Therefore, like in the second aspect, even when none of the pitch designation means are operated, if a pitch designation operation satisfying the above-mentioned condition is performed, the melody tone progresses by one. For example, when an infant performs pitch designation operations with his o her right and left hands using fists or palms, a melody can be smoothly and easily played with both the hands.

In each of the first, second, and third aspects, according to the present invention, if a plurality of pitch designation means are simultaneously operated by a fist or palm, a melody tone progresses by only one tone. Therefore, the present invention is suitable for infants to practice melody performance.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 10A to 10H are views showing internal formats of a working RAM according to the third embodiment of the present invention.

DETAILED DESCRIPTION OF THE PREFERRED EMBODIMENTS

Preferred embodiments of the present invention will be described below with reference to the accompanying drawings.

First Embodiment

{Arrangement}

Figure 1:
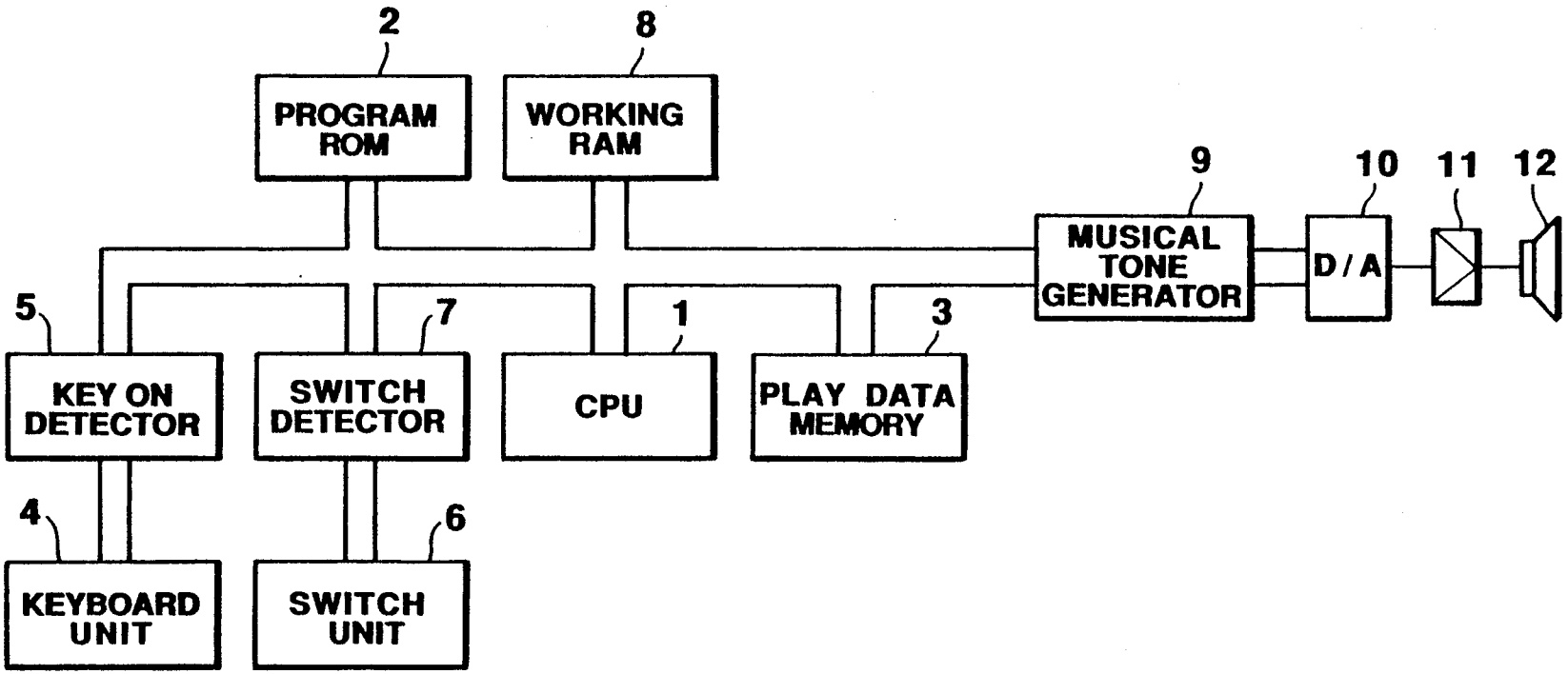
FIG. 1 is a block diagram of a system according to the first embodiment of the present invention.

FIG. 1 is a block diagram showing a system according to the first embodiment of the present invention.

In FIG. 1, a CPU (Central Processing Unit) 1 is operated according to a program stored in a program ROM 2 comprising a read-only memory, and comprises, e.g., a microprocessor.

A performance data memory 3 is a memory for storing auto-play music piece data consisting of melody data and corresponding accompaniment data (consisting of chord, rhythm, bass patterns, and the like). The memory 3 comprises, e.g., a ROM pack which can be detachable with an apparatus main body. The music piece data stored in the performance data memory 3 is read out by the CPU 1 in an ANY KEY mode or an AUTO mode (to be described later).

Figure 2:
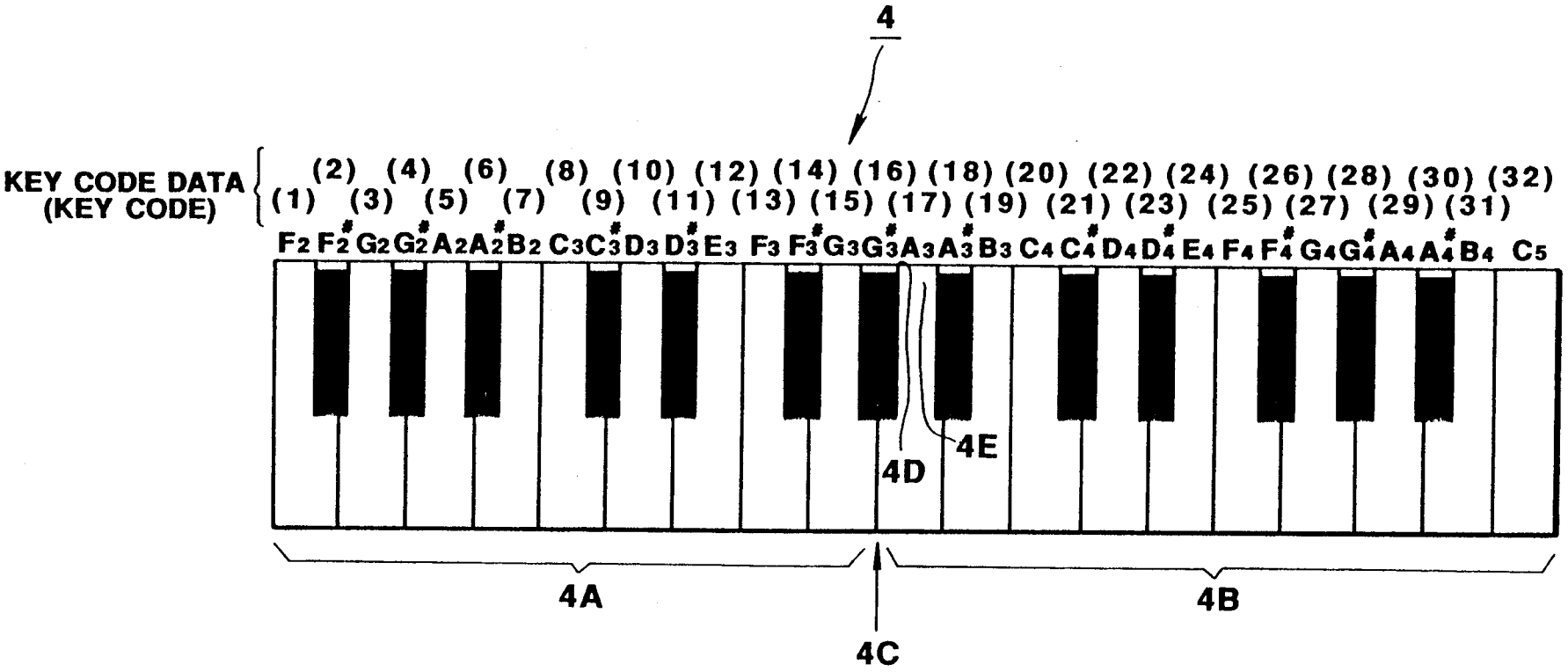
FIG. 2 is a view showing an outer appearance of a keyboard unit.

A keyboard unit 4 has 32 keys for designating pitches (to which key code data as serial numbers are assigned from the minimum pitch) in a 2.5-octave tone range from "$F_2$" to "$C_5$" in units of semitones, as shown in FIG. 2. When each key is depressed, an ON signal is independently output to the CPU 1 via a key ON detector 5; otherwise, an OFF signal is independently output to the CPU 1 via the detector 5.

The CPU 1 sequentially scans a status signal (ON/-OFF signal) output from each key of the keyboard unit 4 via the key ON detector 5 at a predetermined cycle. The CPU 1 stores status data (ON/OFF state) of each key in a key status area 8*a* in a working RAM (random-access memory) 8 for each scan.

A switch unit 6 consists of a switch for selecting one of a PLAY mode, an ANY KEY mode, and an AUTO mode, and switches for selecting rhythms, tone colors, and the like. Status data (ON/OFF state) of each switch is output to the CPU 1 via a switch detector 7.

The respective modes will be explained below.

PLAY mode . . . A musical tone having a pitch corresponding to an ON key is generated according to an ON operation of each key in the keyboard unit 4.

ANY KEY mode . . . The keyboard unit 4 is divided into two portions consisting of a one-key 4A including keys having pitches "$F_2$" to "$G_3$#" and a one-key 4B including keys having pitches "$A_3$" to "$C_5$" via a key split 4C (boundary point between a black key 4D of "$G_3$#" and a white key 4E of "$A_3$". A detailed operation in this mode will be described later.

AUTO mode . . . A melody is automatically played in correspondence with an accompaniment on the basis of melody data and accompaniment data (rhythm, chord, and bass) stored in the performance data memory 3.

The working RAM 8 has various registers and flags used in the ANY KEY mode by the CPU 1, as will be described later, the key status area 8*a* for storing latest status data (ON/OFF state) of each key of the keyboard unit 4, and the like.

A musical tone generator 9 has a digital sound source such as a PCM sound source or a CD sound source, and generates a digital musical tone signal in accordance with a musical tone control signal supplied from the CPU 1. The digital musical tone signal generated by the musical tone generator 9 is converted into an analog musical tone signal by a D/A (digital-to-analog) converter 10, and an actual sound is then produced based on the analog musical tone signal via an amplifier 11 and a loudspeaker 12.

Internal Format of Working RAM

FIGS. 3A to 3D show formats of principal areas used by the CPU 1 in the working RAM 8 when the ANY KEY mode is selected.

Key Status Area

Figure 3A:
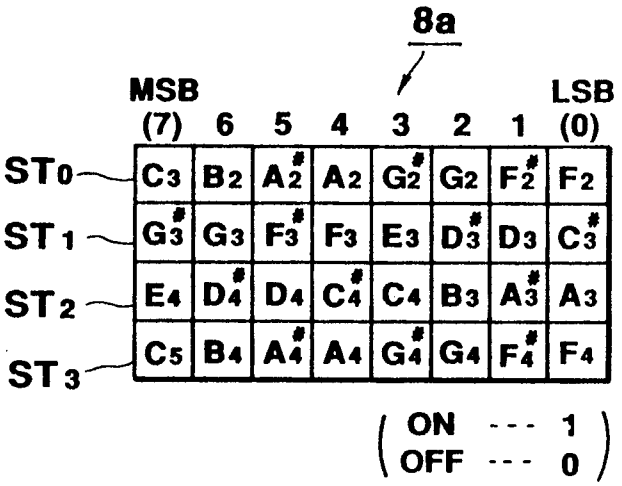
FIGS. 3A to 3D are views showing internal formats of a working RAM in the first embodiment.

FIG. 3A shows a format of the key status area 8*a* for storing latest status data (ON/OFF states) of the 32 keys of the keyboard unit 4.

In the working RAM 8, one word consists of 8 bits. The key status area 8*a* stores four words (32 bits) at addresses $ST_0$, $ST_1$, $ST_2$, and $ST_3$. Status data (ON/-OFF states) of keys from "$F_2$" to "$C_5$" are stored in 32 bits of the key status area 8*a*, respectively. A value of each bit becomes "1" when a corresponding key is depressed, and becomes "0" when it is released.

Key Code Data Area

Figure 3B:
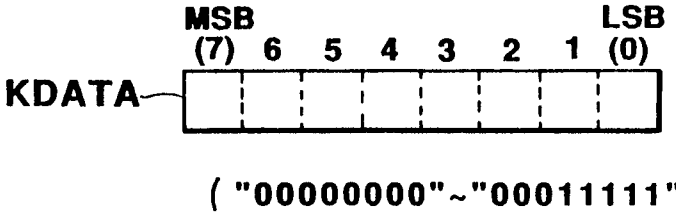

A key code data area KDATA shown in FIG. 3B is a one-word (8-bit) area for storing key code data read out from the performance data memory 3 by the CPU 1. Key code data corresponding to pitches "$F_2$" to "$C_5$" are respectively expressed by serial numbers "00000000" (="$F_2$"), "00000001" ("$F_2$#") , . . . , "00011110" ("$B_4$"), and "00011111" ("$C_5$"), respectively.

Key ON Flag Area

Figure 3C:
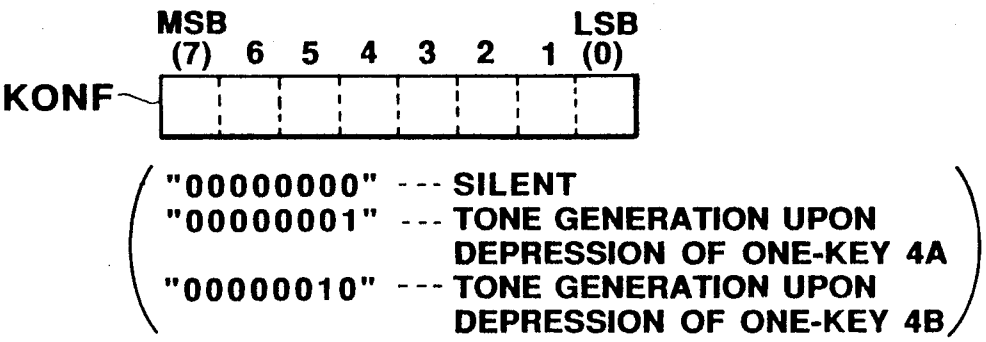

A key ON flag area KONF stores a one-word (8-bit) flag, as shown in FIG. 3C. A key ON flag indicates whether the presently generated melody tone is generated by the one-key 4A or 4B.

"00000000" . . . Silent (no melody tone is generated)

"00000001" . . . A melody tone is generated upon depression of the one-key 4A

"00000010". . . A melody tone is generated upon depression of the one-key 4B

Status Flag Area for One-Keys 4A and 4B

Figure 3D:
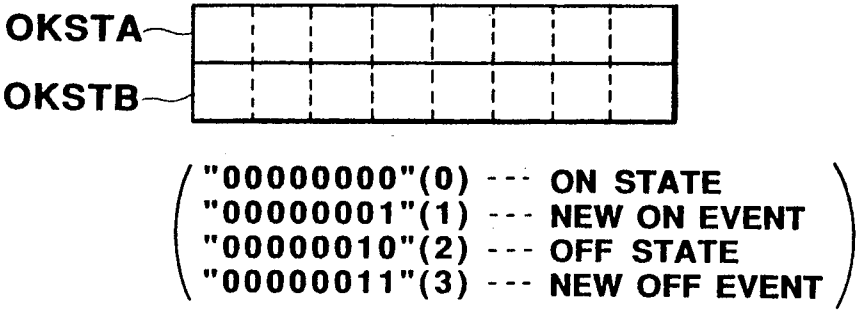

This area stores a status flag OKSTA for the one-key 4A and a status flag OKSTB for the one-key 4B. Each flag is a one-word (8-bit) flag, as shown in FIG. 3D. The status flags OKSTA and OKSTB respectively indicate the latest key ON/OFF state of the one-keys 4A and 4B as follows:

"00000000" (0) . . . An OFF state continues (key OFF state)

"00000001" (1) . . . A key state is newly changed from an OFF state to an ON state (new key ON event)

"00000010" (2) . . . An ON state continues (key ON state)

"00000011" (3) . . . A key state is newly changed from an ON state to an OFF state (new key OFF event)

{Operation}

The operation of the first embodiment will be described below.

Schematic Operation

An operation performed when the ANY KEY mode is selected will be described below.

A player (or user) selects the ANY KEY mode upon operation of the mode selection switch.

Then, the keyboard unit 4 is divided into the one-key 4A consisting of 16 keys for designating pitches from "$F_2$" to "$G_3$#" and the one-key 4B consisting of 16 keys for designating pitches from "$A_3$" to "$C_5$" to have the split point 4C as a boundary, as shown in FIG. 2. Thus, the one-keys 4A and 4B each consisting of 16 keys can be used as the one-keys as described above. More specifically, in either of the one-keys 4A and 4B, a case wherein an arbitrary one key is depressed and a case wherein a plurality of keys are simultaneously depressed are similarly regarded as a single depression of the one-key. Therefore, the one-keys 4A and 4B may be operated by depressing keys one by one with fingers like in a normal performance, and may be operated by simultaneously depressing a plurality of keys with a fist or palm. An operation for depressing at least one of the 16 keys will be expressed as a depression of the one-key 4A or 4B hereinafter. In addition, an operation for releasing all the ON keys of the one-key 4A or 4B from the key ON state will be expressed as a release operation of the one-key 4A or 4B hereinafter.

A predetermined melody stored in advance in the performance data memory 3 is played according to a depression of the one-key 4A or 4B.

In this case, the melody progresses under the following rules.

(1) When the one-key 4A is depressed when both the one-keys 4A and 4B were previously in an OFF state (none of the keys within one-keys 4A and 4B are depressed), a melody tone being generated is muted, and a new melody tone is generated. More specifically, the melody progresses by one tone. The same applies to the one-key 4B.

(2) When the one-key 4A is in an ON state, and when one of the 16 keys in the one-key 4A group is depressed, this ON event is ignored. The same applies to the operation of one-key 4B.

(3) If one-key 4A is depressed (ON state) when the one-key 4B is not depressed, (OFF state) and if the one-key 4B is subsequently depressed, (ON state) a melody tone which is being generated in response to the ON state of the one-key 4A is muted, and a new melody tone is generated. Contrary to this, if the one-key 4B is depressed, (ON state) when the one-key 4A is not depressed, (OFF state) when the one-key 4A is subsequently depressed, a melody tone which is being generated in response to the ON state of the one-key 4B is muted, and a new melody tone is generated.

(4) When neither of the one-keys 4A and 4B is depressed (both OFF) if the one-key 4A is subsequently depressed, and then is released without depressing the one-key 4B, a new melody tone is generated at the key ON timing, and is then muted at the key OFF timing after a predetermined lapse of time. The same applies to the operation of the one-key 4B.

The operation of the CPU 1 which controls melody performance in the ANY KEY mode described above will be described below.

General Flow

Figure 4:
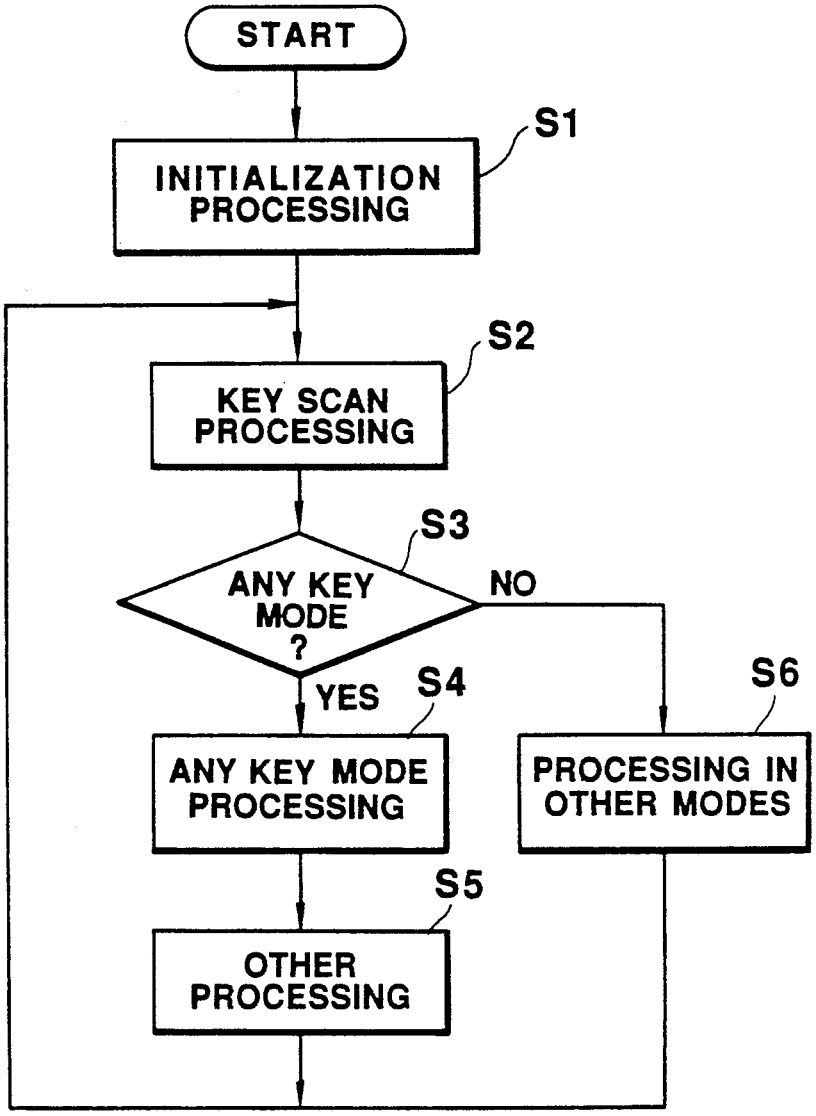
FIG. 4 is a general flow chart of a CPU.

FIG. 4 is a general flow chart for explaining the entire processing executed by the CPU 1 according to a program stored in the program ROM 2.

When a power supply is turned on upon an operation of a switch (not shown), the CPU 1 executes initialization processing (step S1). In the initialization processing, the following operations are executed. That is, all the bits in the key status area 8*a* in the working RAM 8 are cleared to "0", the key ON flag KONF is cleared to "0", the status flags OKSTA and OKSTB are cleared to "0", first key code data is read out from the performance data memory 3, and is stored in the key code data area KDATA, and the like.

The CPU 1 sequentially scans status data (ON/OFF states) of the keys of the keyboard unit 4 via the key ON detector 5, and stores the status data of the respective keys at bit positions corresponding to the keys in the key status area 8*a* (S2).

The CPU 1 reads out a state of the mode selection switch of the switch unit 6 via the switch detector 7 to check if the ANY KEY mode is presently selected (S3).

If the ANY KEY mode is selected, the CPU 1 executes ANY key mode processing in step S4 (to be described in detail later).

The CPU 1 generates rhythm, chord, and bass tones on the basis of accompaniment data consisting of rhythm, chord, and bass patterns stored in the performance data memory 3 (S5). The flow then returns to the key scan processing in step S2.

In this manner, when the ANY KEY mode is selected, processing operations in steps S2 to S5 are repetitively executed.

If it is determined in decision step S3 that a mode other than the ANY KEY mode is selected, processing corresponding to the PLAY or AUTO mode is executed (S6). Since the processing in step S6 is not the principal part of this embodiment, a detailed description thereof will be omitted.

ANY KEY Mode Processing

Figure 5:
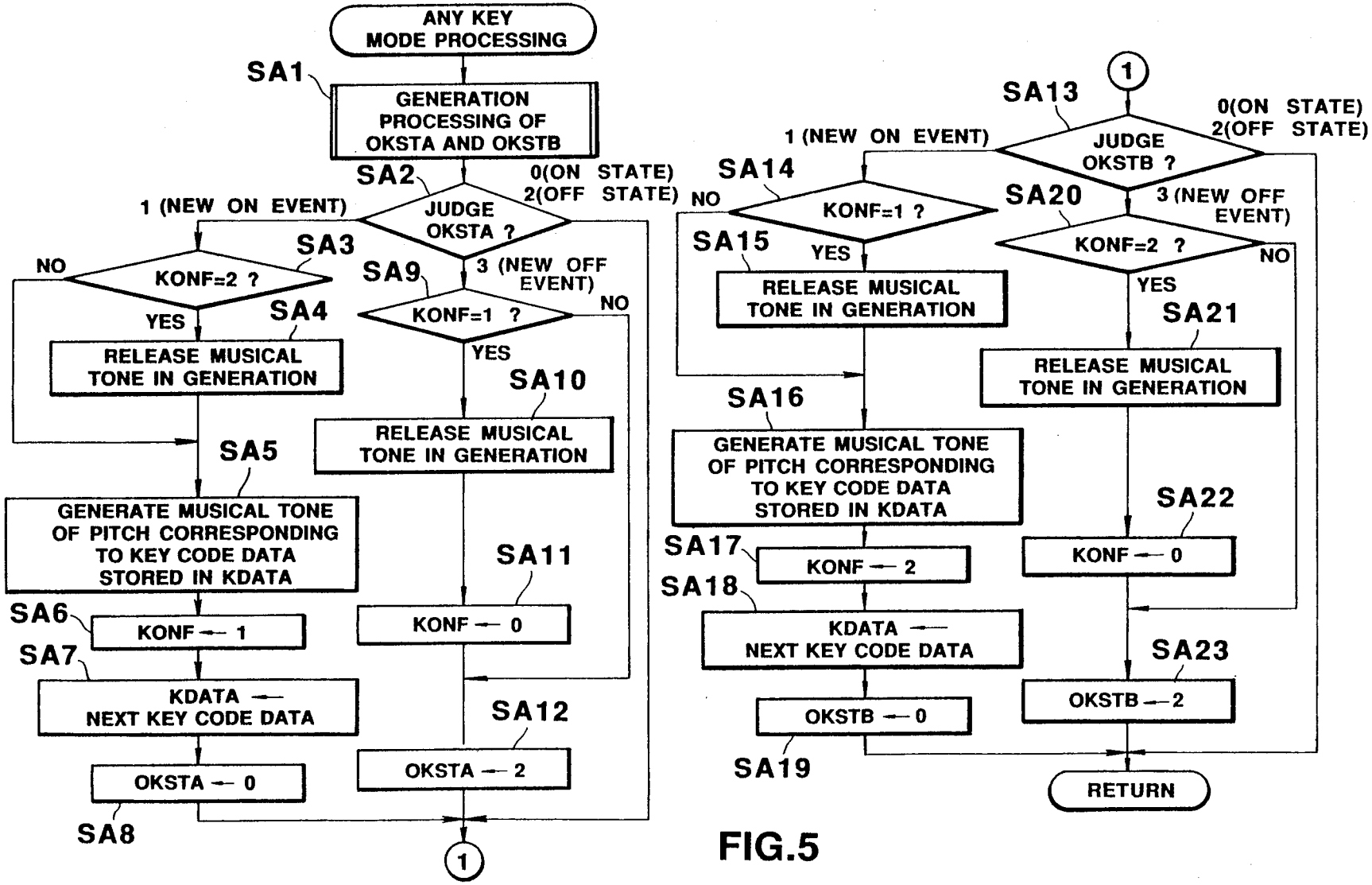
FIG. 5 is a flow chart for explaining processing in an ANY KEY mode executed by the CPU in the first embodiment.

The ANY KEY mode processing in step S4 will be described in detail below with reference to the flow chart of FIG. 5.

The CPU 1 executes OKSTA & OKSTB generation processing (step SA1) for generating the status flags OKSTA and OKSTB on the basis of the ON states of the one-keys 4A and 4B. With the processing in step SA1, "1" (new ON event) or "3" (new OFF event) is set in the status flags OKSTA and OKSTB according to a change in ON/OFF state of the one-keys 4A and 4B.

Subsequently, an indication value of the status flag OKSTA is checked (step SA2). When the value of the status flag OKSTA is "1", i.e., when the one-key 4A is changed from an OFF state to an ON state, it is then checked if the key ON flag KONF is "2", i.e., if a melody tone upon an ON event of the one-key 4B is being generated from the musical tone generator 9 (step SA3). If the key ON flag KONF is "0", i.e., if no melody tone upon an ON event of the one-key 4B is generated from the musical tone generator 9, the CPU 1 reads out key code data stored in the key code data area KDATA, and controls the musical tone generator 9 so that a musical tone having a pitch corresponding to the readout key code data is generated (step SA5).

On the other hand, if the key ON flag KONF is "2", i.e., if a melody tone upon an ON event of the one-key 4B is being generated from the musical tone generator 9, the CPU 1 controls the musical tone generator 9 to mute the presently generated melody tone at a predetermined release time (step SA4), and then executes the processing in step SA5.

After the processing in step SA5 is completed, the key ON flag KONF is set to be "1" (step SA6). The next key code data of the melody is read out from the performance data memory 3, and is stored in the key data area KDATA (step SA7). The status flag OKSTA is set to be "0" indicating an "ON state" (step SA8).

With the above operation, when the one-key 4A is newly depressed in an OFF state of the one-key 4A, if a melody tone is not in generation, the next melody tone is immediately generated. If a melody tone upon an ON event of the one-key 4B is being generated upon a new ON event of the one-key 4A, the melody tone in generation is muted at a predetermined release time, and the next melody tone is generated. The key ON flag KONF is set to be "1", the status flag OKSTA is set to be "0", and key code data indicating a pitch of the next melody tone is stored in the key tone data area KDATA.

If it is determined in decision step SA2 that the status flag OKSTA is "3", i.e., that the one-key 4A is newly released, it is checked if the key ON flag KONF is "1", i.e., if a melody tone upon an ON event of the one-key 4A is being generated (step SA9). If Y (YES) in step SA9, the CPU 1 controls the musical tone generator 9 to mute the musical tone in generation at a predetermined release time (step SA10). The key ON flag KONF is set to "0" (silent), and the status flag OKSTA is set to "2" (OFF state) (steps SA11 and SA12).

With the above operation, after the one-key 4A is depressed to generate a predetermined melody tone, when the one-key 4A is released after a lapse of a predetermined period of time without depressing the one-key 4B, the melody tone which is generated upon an ON event of the one-key 4A is muted at a predetermined release time. The key ON flag KONF is set to be "0" (silent), and the status flag OKSTA is set to be "2" (OFF state).

On the other hand, if it is determined in step SA9 that the key ON flag KONF is not "1", the processing in step SA12 is executed, and the status flag OKSTA is set to be "0" (OFF state).

With the above operation, when the one-key 4A is changed from an ON state to an OFF state, if no melody tone upon an ON event of the one-key 4A is generated, the status flag OKSTA is set to be "0" to indicate that the one-key 4A is released.

On the other hand, if it is determined in decision step SA2 that the status flag OKSTA is neither "0" (OFF state) nor "2" (ON state), the flow immediately advances to step SA14.

With the above operation, after an arbitrary key of the one-key 4A is depressed once, when another key of the one-key 4A is newly depressed, the next melody tone cannot be generated, and the presently generated melody tone is kept generated.

After the processing in step SA8 or SA12 is completed, or if it is determined in step SA2 that the status flag OKSTA is "0" or "2", processing according to the ON or OFF event of the one-key 4B is performed on the basis of the value of the status flag OKSTB for the one-key 4B. Since this processing is almost the same as that according to the ON or OFF event of the one-key 4A described above, a detailed description of an operation will be omitted, and only processing associated with an OFF/ON event of the one-key 4B will be described below.

When the one-key 4B is newly depressed in its OFF state, it is determined that the status flag OKSTB is "1" (step SA13). It is then checked if a melody tone upon an ON event of the one-key 4A is being generated from the musical tone generator 9 (step SA14). If Y in step SA14, the melody tone generated from the musical tone generator 9 is muted at a predetermined release time (step SA15). A musical tone having a pitch corresponding to key code data stored in the key code data area KDATA is then generated from the musical tone generator (step SA16).

With the above operation, when the one-key 4B is newly depressed in an OFF state of the one-key 4B, if a melody tone upon an ON event of the one-key 4A is being generated, the melody tone is muted, and the next melody tone is newly generated from the musical tone generator 9.

On the other hand, if no melody tone upon an ON event of the one-key 4A is generated when the one-key 4B is depressed, the next melody tone is immediately generated (step SA14→step SA16).

The key ON flag KONF is set to be "2" (ON state) (step SA17), and the next key code data is read out from the performance data memory 3 and is stored in the key code data area KDATA (step SA18). In addition, the status flag OKSTB is set to be "0" (ON state) (step SA19).

When the one-key 4B is newly released, it is determined that the value of the status flag OKSTB is "3" (SA14). It is then checked if the key ON flag KONF is "2" (a melody tone upon an ON event of the one-key 4B is being generated) (step SA20). If Y in step SA20, the musical tone generator 9 is controlled to mute a melody tone generated upon an ON event of the one-key 4B at a predetermined release time (step SA21). The key ON flag KONF is set to be "0" (silent), and the status flag OKSTB is set to be "2" (OFF state) (steps SA22 and SA23).

With the above operation, when the one-key 4B is released before the one-key 4A is newly depressed, a melody tone upon an ON event of the one-key 4A is muted after the OFF event at a predetermined release time.

If it is determined in step SA20 that the key ON flag KONF is not "2", the status flag OKSTB is set to be "2" (OFF state) (step SA23).

With the above operation, when the one-key 4B is changed from an ON state to an OFF state, if no melody tone upon an ON event of the one-key 4B is being generated, the status flag OKSTB is set to be "2" (OFF state) to indicate that the one-key 4B is released.

Generation Processing of Status Flags OKSTA and OKSTB

Figure 6:
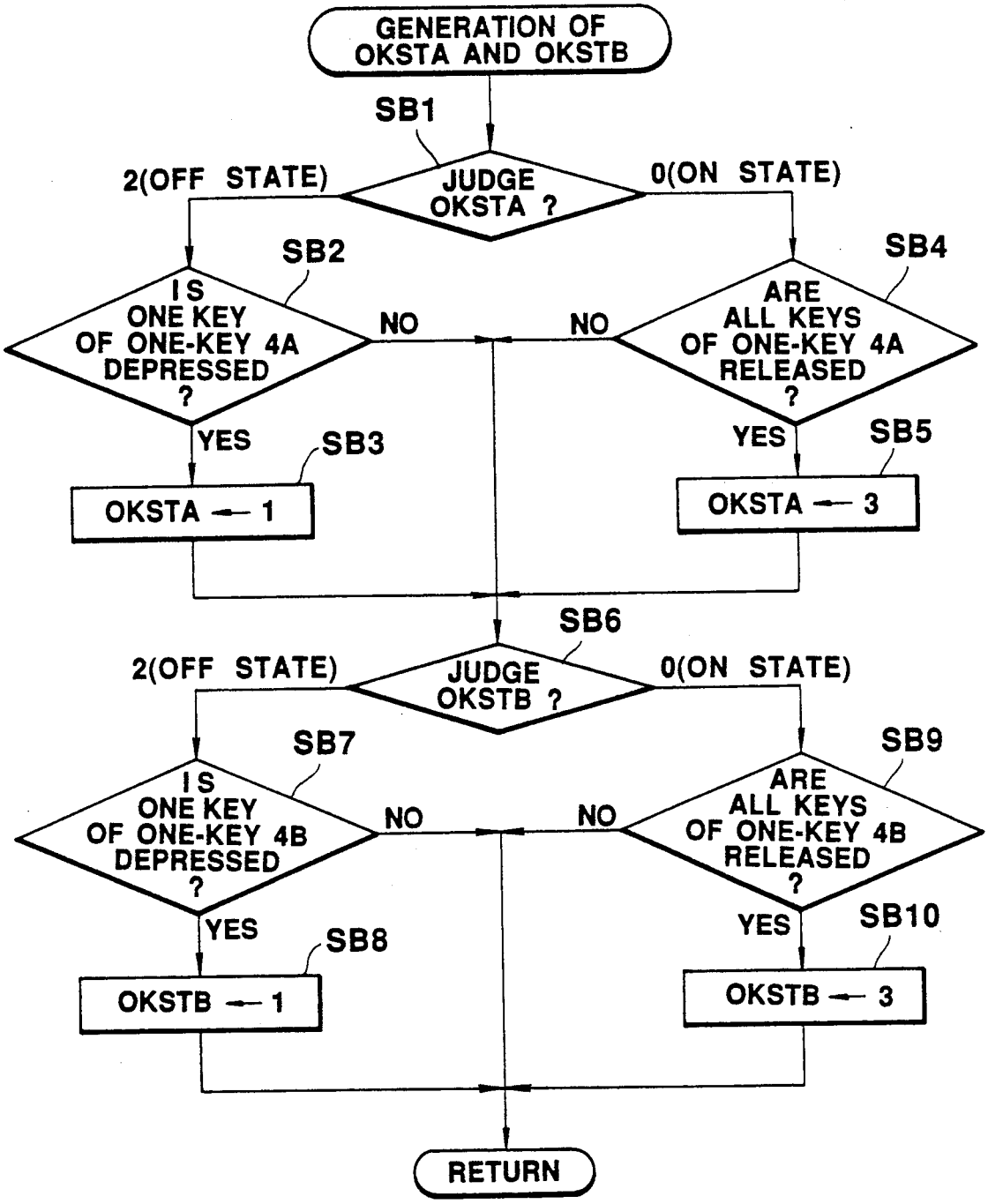
FIG. 6 is a flow chart for explaining generation processing of OKSTA and OKSTB executed by the CPU in the first embodiment.

The generation processing of the status flags OKSTA and OKSTB (step SA1) shown in the flow chart of FIG. 5 will be described in detail below with reference to the flow chart of FIG. 6.

The CPU 1 checks if the status flag OKSTA is "0" (ON state) or "2" (OFF state) (step SB1). If it is determined that the status flag OKSTA is "2" (OFF state), the CPU 1 sequentially scans bits corresponding to the keys of the one-key 4A in the key status area 8*a* to check if at least on key belonging to the one-key 4A is in an ON state (step SB2).

If Y in step SB2, the status flag OKSTA is set to be "1" (new ON event) (step SB3).

With the above operation, when at least one key belonging to the one-key 4A is depressed in a state wherein all the keys belonging to the one-key 4A are released, the status flag OKSTA is set to be "1" (new ON event).

On the other hand, if it is determined in step SB1 that the flag OKSTA is "0" (ON state), the CPU 1 scans bits corresponding to all the keys belonging to the one-key 4A in the key status area 8*a* to check if all the keys belonging to the one-key 4A are released (step SB4). If Y in step SB4, the CPU 1 sets the status flag OKSTA to be "3" (new OFF event) (step SB5).

With the above operation, when a key state is changed from an ON state (a state wherein at least one key belonging to the one-key 4A is depressed) to an OFF state (a state wherein all the keys belonging to the one-key 4A are released), the status flag OKSTA is set to be "3" (new OFF event).

The same processing as that for the one-key 4A is executed for the one-key 4B (steps SB6 to SB10). More specifically, when a key state is changed from an OFF state (a state wherein all the keys belonging to the one-key 4B are released) to an ON state (a state wherein at least one key belonging to the one-key 4B is depressed), the status flag OKSTB is set to be "1" (new ON event) (step SB6→SB7 SB8). Contrary to this, when a key state of the one-key 4B is changed from an ON state to an OFF state, the status flag OKSTB is set to be "3" (new OFF event) (step SB6→SB9→SB10).

In this manner, according to this embodiment, the keyboard unit 4 is divided into the one-keys 4A and 4B each consisting of 16 keys to have the key split 4C as a boundary. An operation for alternately depressing the one-keys 4A and 4B, or an operation for solely depressing only the one-key 4A or 4B (in this case, when given keys are depressed, all the ON keys are released, and then other keys are then depressed) is performed, melody tones are sequentially generated according to ON timings. The ON event of the one-key 4A or 4B is valid only when all the keys are released. Even when an infant depresses a plurality of keys with his or her fist or palm, only one melody tone is generated. Therefore, the apparatus of this embodiment is suitable for an infant to practice melody performance. Since melody performance can be performed by alternately depressing the one-keys 4A and 4B with both hands, a user can experience an actual performance feeling.

In this embodiment, the keyboard unit is divided into two keys. The number of divisions of the keyboard unit is not limited to two but may be three or more. All the keys need not always be used for the one-keys, and only portions at two ends of the keyboard unit may be assigned to the one-keys.

When key code data includes not only pitch data but also tone duration data and rest data, ON timings can be detected on the basis of the tone duration and rest data. In addition, display members comprising LEDs can be arranged in a one-to-one correspondence with the keys of the keyboard, and a display member corresponding to a key to be depressed can be turned on in synchronism with an ON timing. In this case, when keys are depressed in synchronism with the ON timings of the display members, a beginner and an infant can play a melody in correct tempo and rhythm.

The same effect as in the first embodiment can be obtained by the second and third embodiments to be described below.

Second Embodiment

The second embodiment is made in consideration of the fact that the number of keys which can be simultaneously depressed by a fist or palm of, e.g., an infant is at most about 4 to 5. Thus, when the total number of ON keys is changed from a range of one to five to a range of six or more, a new ON event is accepted. For example, assume that five keys have already been depressed by the left hand, and other keys are further depressed by the right hand. In this case, in a conventional apparatus, an ON event by the right hand is ignored since it is not made from an OFF state. According to the second embodiment, however, such an ON event can be accepted.

The system arrangement of the second embodiment is the same as that of the first embodiment shown in FIG. 1, and its operation mode includes the PLAY mode, the ANY KEY mode, and the AUTO mode like in the first embodiment. However, the operation in the ANY KEY mode is different from that in the first embodiment.

The operation in the ANY KEY mode in the second embodiment will be described hereinafter.

Principal areas in the working RAM 8 used by the CPU 1 when the ANY KEY mode is selected will be explained below.

Figure 7A:
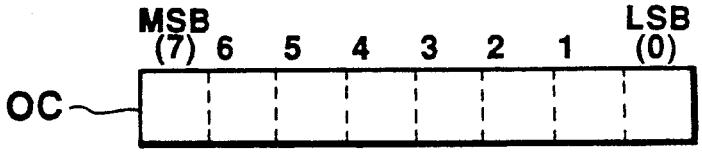
FIGS. 7A to 7C are views showing internal formats of a working RAM according to the second embodiment of the present invention.
Figure 7B:
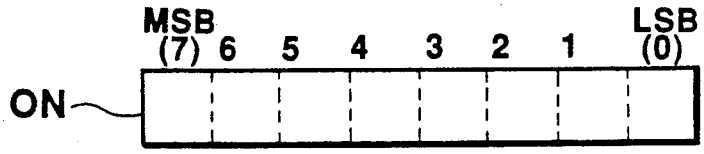
Figure 7C:
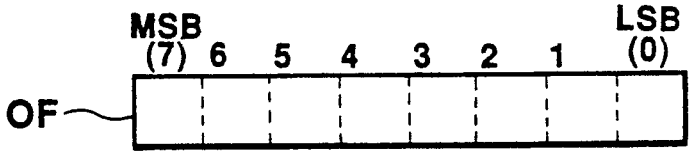

FIGS. 7A to 7C show principal areas in the working RAM 8.

ON Counter

An ON counter OC is a 1-word (8-bit) counter, as shown in FIG. 7A, and stores the latest number of ON keys of the keyboard unit 4.

Previous ON Counter

A previous ON counter ON is a one-word (8-bit) counter, as shown in FIG. 7B, and stores the number of ON keys which were detected during a previous scan operation of status data of keys of the keyboard unit 4.

ON Key Flag

An ON key flag OF is a one-word (8-bit) flag, as shown in FIG. 7C. If the number of ON keys is six or more, its LSB (0th bit) is set to be "1", and if the number of ON keys is 11 or more, its 1st bit is set to be "1".

In the working RAM 8 of the second embodiment, the key status area 8*a* (FIG. 3A) and the key code data area KDATA (FIG. 3B) are also allocated in addition to the areas OC, ON, and OF.

{Operation}

The operation of the second embodiment will be described below.

Schematic Operation

The operation of the ANY KEY mode as the feature of the present invention will be described below.

When a player selects the ANY KEY mode upon operation of the mode selection switch, a melody stored in the performance data memory 3 progresses under the following rules:

(1) When at least one key is depressed in a state wherein none of the keys of the keyboard unit 4 are depressed, a melody tone progresses by one tone.

(2) When a new ON event is made in a state wherein the number of ON keys of the keyboard unit 4 falls within a range of 1 to 5, and the number of ON keys exceeds 6, a melody tone progresses by one tone.

(3) In a state wherein the number of ON keys of the keyboard unit 4 falls within a range of 6 to 10, when a new ON event is detected and the number of ON keys exceeds 11, a melody tone progresses by one tone.

Contrary to this, a new ON event of a key of the keyboard unit 4 is ignored in the following cases.

(1) The number of ON keys is left unchanged or decreased.

(2) In a state wherein the number of ON keys falls within a range of 1 to 4, a new ON event is detected, but the number of ON keys does not reach 6.

(3) In a state wherein the number of ON keys falls within a range of 6 to 9, a new ON event is detected, but the number of ON keys does not reach 11.

The operation of the CPU 1 for controlling melody performance in the ANY KEY mode according to the above-mentioned rules will be described below.

Since the general flow is the same as that in the first embodiment, only processing in the ANY KEY mode will be explained below.

Figure 8:
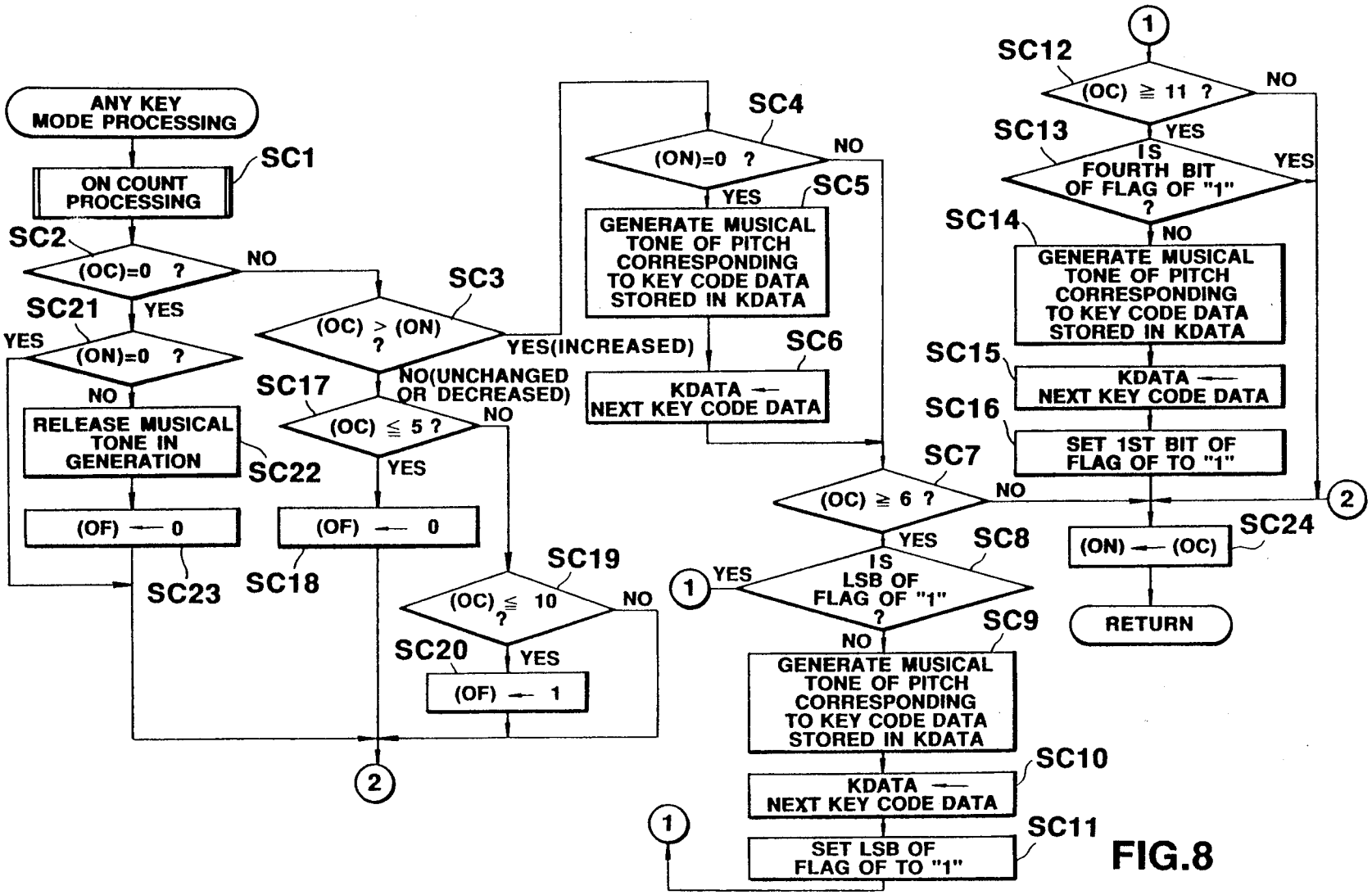
FIG. 8 is a flow chart for explaining processing in an ANY KEY mode executed by a CPU in the second embodiment.

FIG. 8 is a flow chart for explaining melody generation control processing executed by the CPU 1 in the ANY KEY mode. Before the processing in the ANY KEY mode shown in FIG. 8 is executed, first key code data stored in the performance data memory 3 is stored in the key code data area KDATA, and the ON counter OC, the previous ON counter ON, and the ON key flag OF are reset to "0".

The CPU 1 executes ON count processing (step SC1) for counting the number of ON keys from those of the keyboard unit 4, and stores the number of ON keys in the ON counter OC. Note that the ON count processing in step SC1 will be described in detail later.

It is checked if the content of the counter OC is "0", i.e., if there is no ON key (step SC2). If at least one key is depressed, the contents of the previous ON counter and the ON counter OC are compared with each other (step SC3). Note that (ON) and (OC) in the flow chart represent the contents of the counters ON and OC, respectively.

If the content of the ON counter OC is larger than the previous ON counter ON, i.e., if the number of ON keys is increased, it is then checked if the content of the previous ON counter ON is "0", i.e., if the previous number of ON keys is "0" (step SC4). If Y in step SC4, the CPU 1 reads out the key code data stored in the key code data area KDATA, and controls the musical tone generator 9 to generate a musical tone having a pitch corresponding to the readout key code data (step SC5). Thereafter, the CPU 1 reads out the next key code data from the performance data memory 3, and stores it in the key code data KDATA (step SC6). Subsequently, it is checked if the content of the ON counter OC is equal to or larger than 6 (step SC7). If N (NO) in step SC7, the content of the ON counter OC is stored in the previous ON counter ON (step SC24).

However, if Y in step SC7, processing in step SC8 and subsequent steps (to be described later) is executed.

With the above operation, when a key is depressed in a state wherein none of keys of the keyboard unit 4 are depressed, the next melody tone is generated. Therefore, when an infant depresses a plurality of keys of the keyboard unit 4 with his or her fist or palm, only the first melody tone o the next corresponding melody tone is generated.

If it is determined in step SC4 that the content of the previous ON counter ON is not "0", that is, when an arbitrary number of keys are depressed in a state wherein at least one key has been depressed, it is checked if the content of the ON counter OC is equal to or larger than "6", i.e., a total number of ON keys exceeds 6 by the present new ON event (step SC7). If Y in step SC7, it is checked if the LSB (least significant bit) of the ON key flag OF is "1" (step SC8). The LSB of the ON key flag OF is set to be "1" when the number of ON keys is changed from a range of 1 to 5 to a range exceeding 6. Therefore, the decision processing in step SC8 is executed to check if the previous number of ON keys is equal to or larger than 6.

If it is determined in step SC8 that the LSB of the ON key flag OF is not "1", i.e., that the previous number of ON keys is equal to or smaller than 5, steps SC9 and SC10 similar to steps SC5 and SC6 are executed. More specifically, a musical tone having a pitch corresponding to key code data stored in the key code data area KDATA is generated (step SC9), the next key code data of a melody is stored in the key code data area KDATA (step SC10), and the LSB of the ON key flag OF is set to be "1" (step SC11). Thereafter, processing in step SC24 is executed, and the flow returns to the main routine.

With the above operation, when the number of ON keys is increased from 5 or less to 6 or more, the next melody tone is generated. Therefore, when an infant depresses keys of the keyboard unit 4 with his or her one fist or palm while he or she depresses keys of the keyboard unit 4 with his or her other fist or palm, and when the total number of ON keys becomes equal to or larger than 6, the next melody tone is generated by one tone. In addition, the present number of ON keys is set in the previous ON counter ON (step SC24).

If it is determined in step SC8 that the LSB of the ON key flag OF is "1", i.e., the previous number of ON keys is equal to or larger than 6, and six keys or more are further depressed, the flow advances to step SC12. It is checked in step SC12 if the content of the ON counter OC exceeds "11", i.e., a new total number of ON keys exceeds "11". If Y in step SC12, it is checked if the 1st bit of the ON key flag OF is "1" (step SC13). As will be described later, the 1st bit of the ON key flag OF is set to be "1" when the number of ON keys is changed from 10 or less to 11 or more. Therefore, in step SC13, it is checked if the previous number of ON keys is equal to or smaller than 10. If it is determined in step SC13 that the number of ON keys is equal to or smaller than 10, steps SC14 and SC15 similar to steps SC5 and SC6 are executed. More specifically, a musical tone having a pitch corresponding to key code data stored in the key code data area KDATA is generated (step S14), and the next key code data of a melody is stored in the key code data area KDATA (step SC15). Then, the 1st bit of the ON key flag OF is set to be "1" (step SC16). Thereafter, processing in step SC24 is executed, and the flow returns to the main routine.

With the above operation, when the number of ON keys is changed from 10 or less to 11 or more, the next melody tone is generated. Therefore, when an infant depresses keys of the keyboard unit 4 with his or her one fist or palm while he or she depresses five to ten keys of the keyboard unit 4 with his or her other fist or palm, and when the total number of ON keys becomes equal to or larger than 11, the next melody tone is generated by one tone.

With the above operation, in a state wherein the number of ON keys falls within the range of 1 to 4, when a new ON event is detected and the number of ON keys is increased, if the number of ON keys is equal to or smaller than 5, the new ON event is ignored, and the next melody tone is not generated. Thus, when a plurality of keys are depressed, even if the respective fingers have different ON timings, only one melody tone is generated.

If it is determined in step SC12 that the content of the ON counter OC is equal to or smaller than 10, i.e., even if the number of ON keys is increased and is equal to or smaller than 10, the flow immediately returns to the main routine after the processing in step SC24 is executed. With the above operation, when a new ON event is detected in a state wherein the number of ON keys falls within the range of 6 to 9, if the total number of ON keys does not exceed 11, the next melody tone is not generated.

If it is determined in step SC13 that the 1st bit of the ON key flag OF is "1", i.e., when 11 keys or more have been depressed before a new ON event, the flow immediately returns to the main routine after the processing in step SC24 is executed.

With the above operation, when the number of ON keys is increased after it exceeds 11, the next melody tone is not generated. In addition, a melody tone can be prevented from being generated in response to an accidental ON event due to various causes.

If it is determined in step SC3 that the content of the ON counter OC is equal to or smaller than the content of the previous ON counter, that is, if the number of ON keys is left unchanged or decreased, it is then checked if the content of the ON counter OC is equal to or smaller than "5", i.e., the present number of ON keys is equal to or smaller than "5" (step SC17). If Y in step SC17, the content of the flag OF is reset to "0", and the flow immediately returns to the main routine after the processing in step SC24 is executed.

With the above operation, when the number of ON keys becomes equal to or smaller than "5", the ON key flag OF is reset to "0". Therefore, if the number of ON keys is equal to or smaller than "5", the 1st bit and the LSB of the ON key flag OF are kept to be "0".

On the other hand, if it is determined in step SC17 that the content of the ON counter OC is equal to or larger than "6", it is then checked if the present number of ON keys is equal to or smaller than "10" (step SC19). If Y in step SC19, the content of the ON key flag OF is set to be "1", i.e., only the LSB of the ON key flag OF is set to be "1" (step SC20). Thereafter, the processing in step SC24 is executed, and the flow immediately returns to the main routine.

With the above operation, when the number of ON keys falls within the range of 6 to 10, the LSB of the ON key flag OF is kept set to be "1".

As described above, when the number of ON keys is left unchanged or decreased, no melody tone is generated, and only the ON key flag OF is set.

If it is determined in step SC2 that the ON counter OC is "0", i.e., the number of ON keys is "0", it is checked if the content of the previous ON counter ON is "0", i.e., if the previous number of ON keys is "0" (step SC21). If N in step SC21, the CPU 1 controls the musical tone generator 9 to mute a musical tone in generation at a predetermined release time (step SC22). Thereafter, the CPU 1 resets the ON key flag OF to be "0" (step SC23). Furthermore, the CPU 1 executes the processing in step SC24. Thereafter, the flow returns to the main routine. However, if Y in step SC21, the processing in step SC24 is executed, and the flow returns to the main routine.

With the above operation, when all the keys of the keyboard unit 4 are released, a musical tone in generation is muted at a predetermined release time. When all the keys are released, the LSB and 1st bit of the ON key flag OF are set to be "0".

In this embodiment, a melody tone is generated in the following three cases when at least one key is depressed in a state wherein none of the keys of the keyboard units 4 are depressed; when a new ON event is detected in a state wherein the number of ON keys is equal to or smaller than 5, and the number of ON keys exceeds 6; and when a new ON event is detected in a state wherein the number of ON keys falls within a range of 6 to 10, and the number of ON keys exceeds 11.

Therefore, when an infant alternately depresses keys with his or her right and left fists or palms, even if he or she depresses keys with one fist or palm before the other hand is completely released, the melody can smoothly progress tone by tone.

In the second embodiment, the reference numbers of ON keys are set to be "6" and "11". However, the numbers of ON keys are not limited to these values, but may be arbitrarily set. In addition, a threshold value of the number of ON keys serving as a judgment reference for generating a melody tone may also be arbitrarily set.

The ON count processing in step SC1 in the flow chart shown in FIG. 8 will be described in detail below with reference to the flow chart in FIG. 9. Note that reference symbols A, B, and C used in the flow chart in FIG. 9 denote versatile registers arranged in the CPU 1. The register C has an 8-bit configuration.

Figure 9:
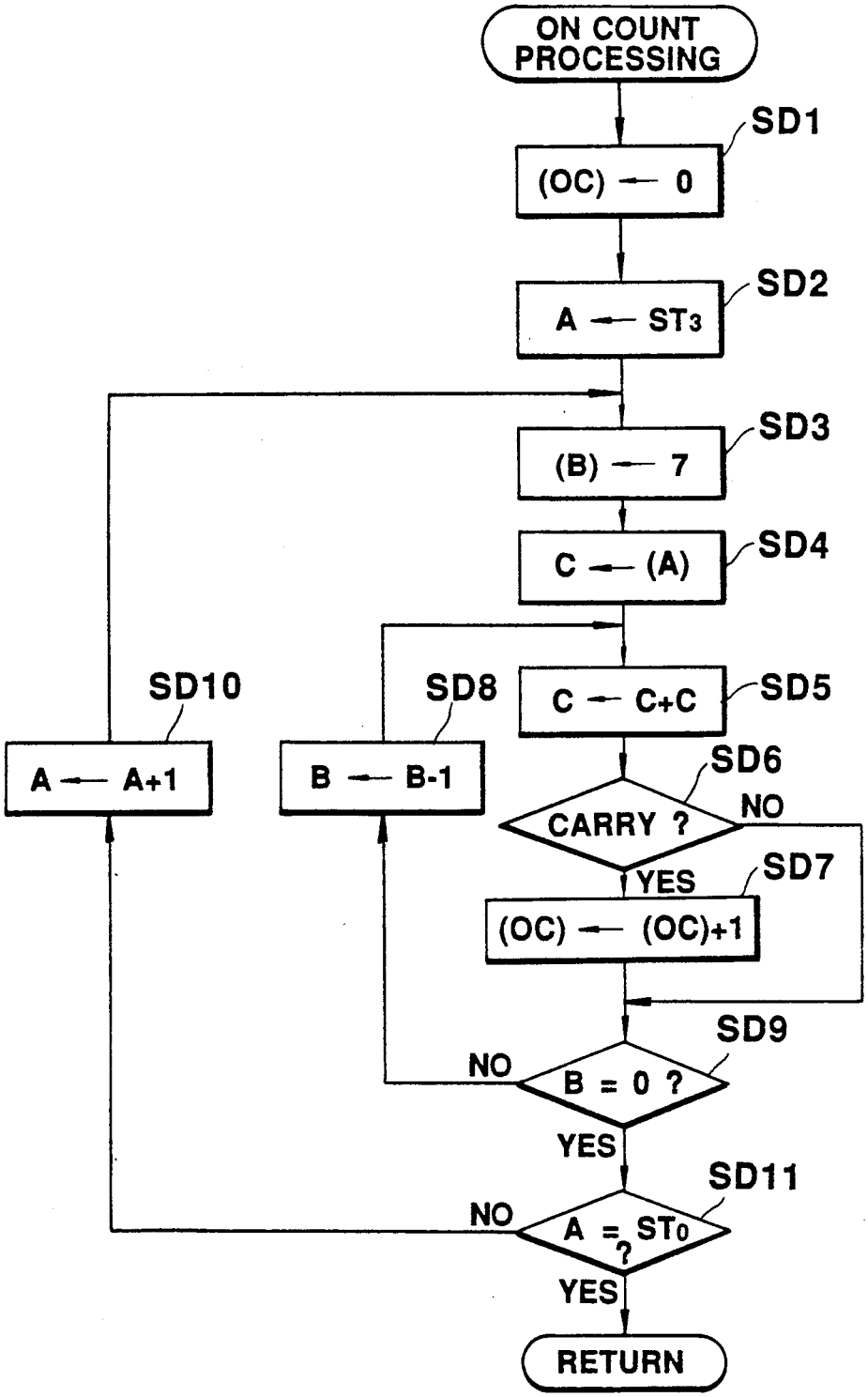
FIG. 9 is a detailed flow chart of ON count processing executed by the CPU in the second embodiment.

In FIG. 9, the CPU 1 sets the content of the ON counter OC to be "0" (step SD1), and stores an end address ST3 of the key status area 8a shown in FIG. 3A in the register A (step SD2).

Subsequently, "7" is set in the register B (step SD3). A value stored at an address position equal to the value of the register A in the key status area 8a is read out, and is stored in the register C (step SD4).

As shown in FIG. 3A, 8-bit data indicating status data (ON event=1 and OFF event=0) of keys corresponding to pitches in a tone range of "$F_4$" to "$C_5$" is stored at the address $ST_3$ in the key status area 8a.

The values stored in the register C are added to each other, and the sum is stored again in the register C (step SD5). Subsequently, it is checked if a carry occurs by the addition (step SD6). If N in step SD6, the content of the ON counter OC is incremented by "1" (step SD7).

In the addition in step SD5, values at identical bit positions are added to each other. Therefore, a "1" bit is carried by one digit. When the MSB of the register C is "1", a carry occurs by the first processing in step SD5, and the content of the ON counter OC becomes "1".

Steps SD5 to SD7 are repeated eight times while the value of the register B which is initialized in step SD3 is decremented by "1" (step SD8) until it is determined that the value of the register B is equal to "0" (step SD9). For each bit of the 8-bit data, whether or not the value of the bit is "1" is checked in turn from the MSB (7th bit) to the LSB (0th bit) toward the lower bit. The 8-bit data at the address $ST_3$ indicates status data of eight keys having pitches from "$F_4$" to "$C_5$". When the value of the register B becomes equal to "0", it is determined that ON events of all the keys in a tone range of "$F_4$" to "$C_5$" have been checked (step SD9), and it is then checked if the address stored in the register A is equal to $ST_0$ (step SD11). In this case, since the address $ST_3$ is stored in the register A, it is determined in step SD11 that the address stored in the register A is not equal to the address $ST_0$. Thus, the value of the register A is decremented by "1", so that the value of the register A is updated to the address $ST_2$ of the key status area 8a (step SD10). Steps SD3 to SD9 are then repeated.

In this manner, steps SD3 to SD9 are repeated four times while sequentially updating the value of the register A like $ST_3 \rightarrow ST_2 \rightarrow ST_1 \rightarrow ST_0$ until it is determined in step SD11 that the value of the register A is equal to the address $ST_0$. Thus, ON events of all the keys of the keyboard unit 4 stored in the key status area 8a are checked, and every time an ON event is detected (step SD6), the content of the counter OC is incremented by "1" (step SD7). When detection of ON events for all the keys is completed, it is determined in step SD11 that the address stored in the register A is the address $ST_0$, and the flow returns to the main routine shown in FIG. 8.

In the flow chart shown in FIG. 8, an ON event is detected on the basis of the presence/absence of a carry occurring when 8-bit data indicating status data of the keys of the keyboard unit 4 are sequentially added. However, the present invention is not limited to such a method. For example, the 8-bit key ON data may be shifted bit by bit toward the LSB to check if the value of each bit is "1" in turn from the MSB, thereby detecting whether or not a key is depressed.

Third Embodiment

The number of keys which can be simultaneously depressed by a fist or palm of, e.g., an infant is at most about 4 to 5. Thus, in the third embodiment to be described below, only when a key separated from an ON key by five keys or more is further depressed, the corresponding ON event is accepted, and the next tone is generated. For example, in a state wherein five keys of key codes 9 to 13 have already been depressed by the left hand, if four keys of key codes 19 to 22 are depressed by the right hand, ON events by the right hand are ignored since some keys have already been depressed in a conventional apparatus. In the third embodiment, however, since the four keys depressed by the right hand are separated by five keys or more from the five keys which have already been depressed by the left hand, the ON event can be accepted as a valid ON event. Therefore, when an infant depresses keys with his or her fists or palms, even if he or she depresses keys with one fist or palm before the other hand is completely released, the melody can satisfactorily progress tone by tone. Furthermore, when keys are depressed with a fist or palm and fingers have different ON timings, a melody progresses by only one tone.

The system arrangement of the third embodiment is also the same as that in the first embodiment shown in FIG. 1. The operation mode of the third embodiment also includes the PLAY mode, the ANY KEY mode, and the AUTO mode like in the first embodiment. However, the operation in the ANY KEY mode is different from that in the first and second embodiments.

Principal areas in the working RAM 8 used in the ANY KEY mode will be explained below with reference to FIGS. 10A to 10H.

MAXNOCODE Area . . . Area for storing key code data corresponding to a key having a maximum pitch of keys corresponding to new ON events MINNOCODE Area . . . Area for storing key code data corresponding to a key having a minimum pitch of key corresponding to new ON events MAXNFCODE Area . . . Area for storing key code data corresponding to a key having a maximum pitch of keys corresponding to OFF events MINNFCODE Area . . . Area for storing key code data corresponding to a key having a minimum pitch of keys corresponding to OFF events MAXCODE Area . . . Area for storing key code data corresponding to a key having a maximum pitch of presently ON keys MINCODE Area . . . Area for storing key code data corresponding to a key having a minimum pitch of presently ON keys ON/OFF Area . . . Area whose LSB (Least Significant Bit) is set to be "1" during tone generation, and is set to be "0" during muting.

D Area . . . Area for storing a reference value for determining whether or not the next melody tone is to be generated upon an ON event. In this embodiment, the reference value is "5" indicating five seminotes.

In the working RAM 8, the key status area 8*a* and the key code data area KDATA are also allocated like in the first embodiment.

{Operation}

The operation of the third embodiment will be described below.

Schematic Operation

The operation in the ANY KEY mode will be described below.

This embodiment is made under an assumption that an infant alternately depresses a keyboard with his or her both fists or palms to play a melody, and takes into consideration the fact that a plurality of keys are simultaneously depressed or released.

When a player selects the ANY KEY mode upon operation of the mode selection switch, a melody stored in the performance data memory 3 is played as follows.

In the ANY KEY mode, keys of the keyboard unit 4 do not serve as those for directly designating corresponding pitches, but serve as trigger means for progressing a melody tone by tone. When the following keyboard operations are performed, melody tones are generated.

(1) A case wherein a new ON event is detected in a state wherein none of the keys are depressed.

(2) A case wherein only a key separated from all the arbitrary ON keys by five keys or more (including both black and white keys) is depressed. Therefore, when one or a plurality of keys located within a distance corresponding to five keys from a given ON key are depressed, the corresponding ON events are ignored, and a melody does not progress.

Figure 11:
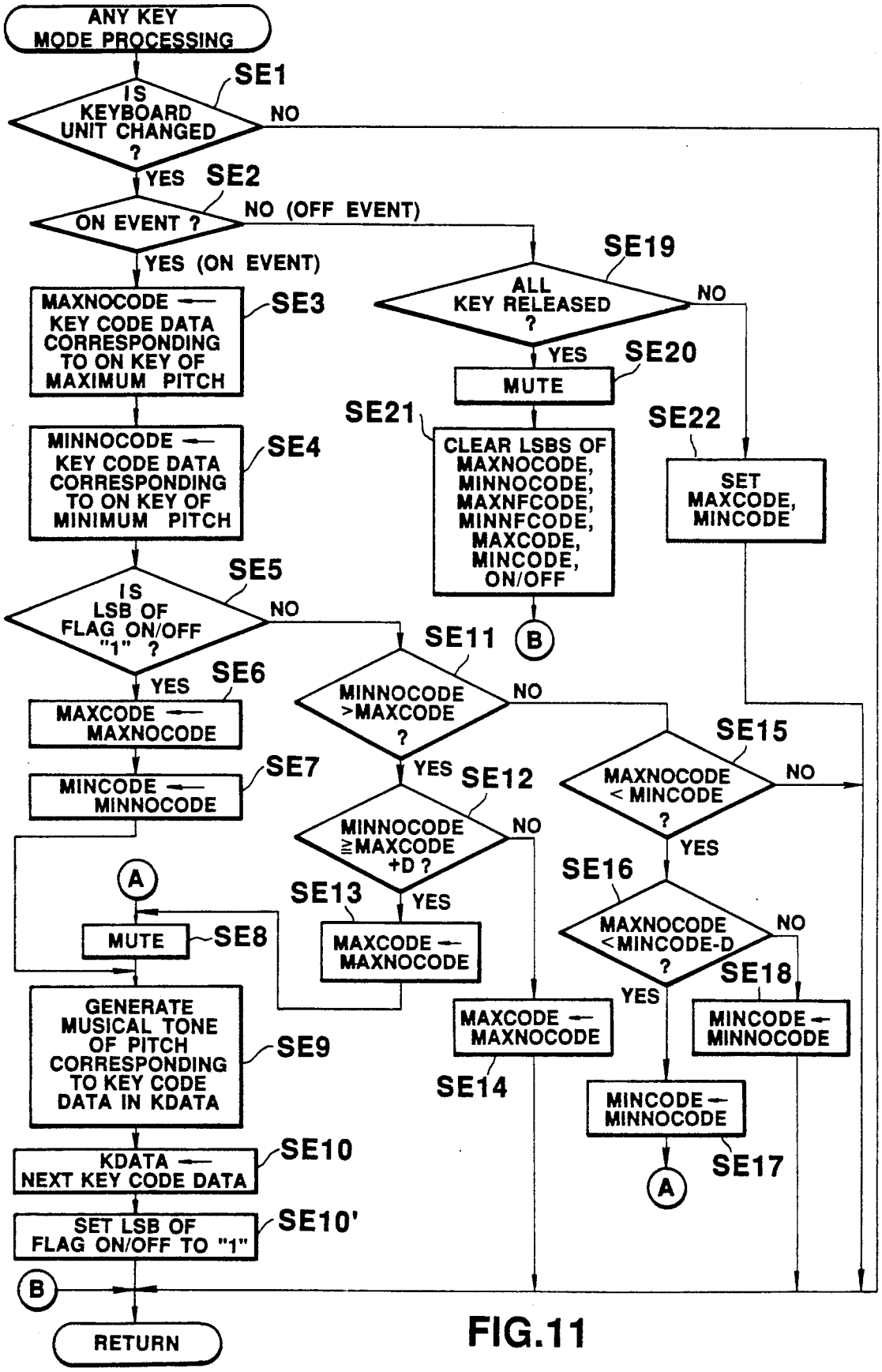
FIG. 11 is a flow chart for explaining processing in an ANY KEY mode executed by a CPU in the third embodiment.

The operation of the CPU 1 which can attain melody performance by the above-mentioned key depression method will be described below with reference to the flow chart shown in FIG. 11. When the ANY KEY mode is selected, first key code data stored in the performance data memory 3 is stored in the key code data area KDATA, and the LSBs of the NOCODE, NFCODE, MAXCODE, MINCODE, and ON/OFF areas are cleared to "0".

The CPU 1 looks up the key status area 8*a* to check if ON states of the keyboard unit 4 are changed (step SE1). If Y in step SE1, it is checked if a new ON event is detected (step SE2). If Y in step SE2, key code data corresponding to a key having a maximum pitch of the keys corresponding to ON events is stored in the MAXNOCODE area (step SE3), and key code data corresponding to a key having a minimum pitch is stored in the MINNOCODE area (step SE4). It is then checked if the LSB of the ON/OFF area is "1", i.e., a melody tone is being generated (step SE4). If it is determined in step SE4 that the LSB is "0", i.e., there is no melody tone in generation, the key code data stored in the MAXNOCODE area is stored in the MAXCODE area (step SE6). Then, the key code data stored in the MINNOCODE area is stored in the MINCODE area (step SE7).

The CPU 1 controls the musical tone generator 9 to generate a musical tone having a pitch corresponding to the key code data stored in the key data area KDATA (step SE9). Subsequently, the CPU 1 reads out the next key code data from the performance data memory 3, and stores it in the key code data area KDATA (step SE10). Furthermore, the CPU 1 sets the LSB of the ON/OFF area to be "1" (step SE10'). The flow then returns to the main routine.

With the above operation, if arbitrary keys are depressed while none of keys are depressed, a tone is generated at the ON timing, and the next key code data is stored in the key code data area KDATA. Key code data corresponding to keys having maximum and minimum pitches of ON keys are respectively stored in the MAXCODE and MINCODE areas. Of course, when only one key is depressed, key code data corresponding to the ON key is stored in the MAXCODE and MINCODE areas.

If it is determined in step SE5 that the LSB of the ON/OFF area is "1", i.e., that the melody tone is being generated, it is checked if the value of the MINNOCODE area is larger than the value in the MAXCODE area, i.e., key code data corresponding to a key of a minimum pitch of the new ON keys is larger than that corresponding to the key of the maximum pitch of the ON keys so far (step SE11). If Y in step SE11, it is then checked if the value stored in the MINNOCODE area is larger than a sum of the values of the MAXCODE area and the D area (step SE12). In this decision step, it can be determined whether or not key code data corresponding to a key separated by five keys or more from the rightmost key of those depressed by, e.g., the left hand is smaller than key code data corresponding to the leftmost key of those depressed by the right hand. If Y in step SE12, the key code data stored in the MAXNOCODE area is stored in the MAXCODE area (step SE13). Thereafter, the musical tone generator 9 is controlled to mute the presently generated musical tone at a predetermined release time (step SE8). Steps SE9, SE10, and SE10' are then executed, and the flow returns to the main routine.

With the above operation, in a state wherein the keyboard 4 is depressed by, e.g., the left hand, when keys separated by five keys or more from the rightmost key (maximum pitch) of those depressed by the left hand are depressed by the right hand, a melody is progressed by one tone. Key code data corresponding to the rightmost key (maximum pitch) of those newly depressed by the right hand is stored in the MAXCODE area. The value of the MINCODE area is left unchanged.

If it is determined in step SE12 that the value of the MINNOCODE area is equal to or smaller than the sum, the key code data stored in the MAXNOCODE area is stored in the MAXCODE area (step SE14) like in step SE13, and the flow then returns to the main routine.

With the above operation, when the keyboard unit 4 is depressed by a palm, if ON events by respective fingers are time-serially offset, a melody can be prevented from successively progressing by several tones.

If it is determined in step SE11 that the value of the MINNOCODE area is equal to or smaller than the value in the MAXCODE area, it is then checked if the value in the MAXNOCODE area is smaller than the value in the MINCODE area (step SE15). If Y in step SE15, it is checked if the value in the MAXNOCODE area is smaller than a difference obtained by subtracting the value in the D area from the value in the MINCODE area (step SE16). In this decision step, it can be determined whether or not the leftmost key (minimum pitch) of those depressed by, e.g., the right hand is separated by five keys or more from the rightmost key (maximum pitch) of those newly depressed by the left hand. If Y in step SE16, the value (key code data) in the MINNOCODE area is stored in the MINCODE area (step SE17). Thereafter, the processing operations in steps SE8 to SE10' are executed, and the flow then returns to the main routine.

With the above operation, in a state wherein the keyboard unit 4 is depressed by, e.g., the right hand, when keys separated by five keys or more from the left-most key of those depressed by the right hand are depressed by the fist or palm of the left hand, a melody progresses by one tone. Key code data corresponding to the newly depressed leftmost key is stored in the MINCODE area.

If it is determined in step SE16 that the value in the MAXNOCODE area is equal to or larger than the difference, the value in the MINNOCODE area is stored in the MINCODE area (step SE18). Thereafter, the flow immediately returns to the main routine.

With the above operation, when keys are depressed by fingers of a fist or palm not simultaneously but time-serially, a melody can be prevented from successively progressing by several tones.

If it is determined in step SE2 that an OFF event is detected, it is then checked with reference to the key status area 8*a* if all the keys are released (step SE19). If Y in step SE19, step SE20 similar to step SE8 is executed to mute the presently generated melody tone at a predetermined release time. Thereafter, the LSBs of the MAXNOCODE, MINNOCODE, MAXNFCODE, MINNFCODE, MAXCODE, MINCODE, and ON/OFF areas are cleared to "0" (step SE21). Thereafter, the flow returns to the main routine.

With the above operation, when all the keys of the keyboard unit 4 are released, a melody tone in generation is muted at a predetermined release time.

On the other hand, if it is determined in step SE19 that ON keys remain, key code data corresponding to keys of maximum and minimum pitches of those which are presently depressed are respectively stored in the MAXCODE and MINCODE areas (step SE22). Thereafter, the flow returns to the main routine.

With the above operation, if the release operation is performed, key code data corresponding to a key of a maximum pitch (rightmost key) of ON keys is stored in the MAXCODE area, and key code data corresponding to a key of a minimum pitch (leftmost key) is stored in the MINCODE area. For example, in a state wherein the keyboard unit 4 is depressed by both the hands, when only one hand is released, the melody tone can be kept output. When both the hands are released, the melody tone is muted.

In the third embodiment, the value in the D area is set to be "538 . However, the present invention is not limited to this. For example, the value in the D area may be desirably set according to the shape or size of an electronic musical instrument.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electronic musical instrument comprising:

a plurality of pitch designation means divided into a plurality of group designation means, said pitch designation means being operable to designate pitches;

pitch data storage means for storing pitch data indicating pitches of melody tones constituting a melody;

readout means for sequentially reading out the pitch data from said pitch data storage means;

tone generation processing means for executing tone generation processing on the basis of the pitch data read out by said readout means; and control means for enabling said tone generation processing means to execute tone generation processing responsive to both of:

operation of at least one of said pitch designation means; and when none of said pitch generation means in a group designation means including previously operation pitch designation means is subsequently operated; and said control means disabling said tone generation processing means from executing the tone generation processing when at least one pitch designation means in a group designation means including any previously operation pitch designation means is subsequently operated.

2. An instrument according to claim 1, wherein said plurality of pitch designation comprises a plurality of keys.

3. An electronic musical instrument comprising:

a plurality of pitch designation means respectively operable to designate pitches;

pitch data storage means for storing pitch data indicating pitches of melody tones constituting a melody;

readout means for sequentially reading out the pitch data from said pitch data storage means; and tone generation processing means for executing tone generation processing on the basis of the pitch data read out by said readout means; and control means for enabling said tone generation processing means to execute tone generation processing responsive to at least one of:

operation of at least one of said pitch designation means when none of the pitch designation means was previously operated; and the operated pitch designation means changing from a number in a first range to a number in a second range, a lowest value number in the second range being greater than a highest value number in the first range; and said control means disabling said tone generation processing means from executing the tone generation except when enabled.

4. An instrument according to claim 3, wherein said plurality of pitch designation comprises a plurality of keys.

5. An instrument according to claim 3, for use by an operator having two hands, wherein the first range comprises a first number of pitch designation means which can be operated simultaneously by one of said hands of said operator; and the second range comprises a second number larger than the first number of pitch designation means which can be operated simultaneously by said two hands of said operator.

6. An instrument according to claim 5, wherein said plurality of pitch designation means comprises a plurality of keys.

7. An electronic musical instrument comprising:

a plurality of pitch designation means, each of which is assigned to a pitch, for designating pitches;

pitch data storage means for storing pitch data indicating pitches of melody tones constituting a melody;

readout means for sequentially reading out the pitch data from said pitch data storage means; and tone generation processing means for executing tone generation processing on the basis of the pitch data read out by said readout means; and control means for enabling said tone generation processing means to execute tone generation processing responsive to at least one of:

at least one of said pitch designation means being operated at a time when no pitch designation means has been previously operated; and one of said pitch designation means being operated whose pitch differs from that of a pitch designation means which has previously been operated by not less than a predetermined value; and said control means disabling said tone-generation processing means from executing tone generation processing except when enabled.

8. An instrument according to claim 7, wherein said plurality of pitch designation means comprises a plurality of keys.

9. An electronic musical instrument comprising:

a plurality of pitch designation means operable to designate pitches;

pitch data storage means for storing pitch data indicating pitches of melody tones constituting a melody;

readout means for sequentially reading out the pitch data from said pitch data storage means;

tone generation processing means for executing tone generation processing on the basis of the pitch data read out by said readout means; and control means for enabling said tone generation processing means to execute tone generation processing only when at least one of said pitch generation means is operated when none of the other pitch designation means is presently operated, and for disabling said tone generation processing means from executing the tone generation processing when at least one of said pitch designation means is operated when at least one pitch designation means is presently operated.

* * * * *

UNITED STATES PATENT AND TRADEMARK OFFICE

CERTIFICATE OF CORRECTION

PATENT NO. : 5,085,117

DATED : February 4, 1992

INVENTOR(S) : MOROKUMA et al.

It is certified that error appears in the above-indentified patent and that said Letters Patent is hereby corrected as shown below:

Title page, under:

Item [30] "Foreign Application Priority Data"

after "1-118976" insert --[U]--;

after "2-75253" insert --[U]--

Signed and Sealed this

Thirtieth Day of September, 1997

*Attest:*

*Attesting Officer*

BRUCE LEHMAN

*Commissioner of Patents and Trademarks*